US008684318B2

(12) United States Patent
Chadda et al.

(10) Patent No.: US 8,684,318 B2
(45) Date of Patent: Apr. 1, 2014

(54) MECHANICAL LOCK

(75) Inventors: Iqbal Chadda, Bishop's Stortford Hertfordshire (GB); Hari Reddi, Enfield (GB)

(73) Assignee: SPX International Limited (GB)

( * ) Notice: Subject to any disclaimer, the term of this patent is extended or adjusted under 35 U.S.C. 154(b) by 242 days.

(21) Appl. No.: 13/234,959

(22) Filed: Sep. 16, 2011

(65) Prior Publication Data

US 2012/0068022 A1 Mar. 22, 2012

Related U.S. Application Data

(60) Provisional application No. 61/383,539, filed on Sep. 16, 2010.

(51) Int. Cl.
*E01B 7/02* (2006.01)

(52) U.S. Cl.
USPC ..... 246/448; 246/450

(58) Field of Classification Search
USPC ..... 246/448–453
See application file for complete search history.

(56) References Cited

U.S. PATENT DOCUMENTS

| | | | | |
|---|---|---|---|---|
| 4,799,577 | A * | 1/1989 | de Carbon | 188/277 |
| 5,366,313 | A * | 11/1994 | LaBarre | 403/108 |
| 5,462,245 | A | 10/1995 | Durchschlag | |
| 5,566,912 | A * | 10/1996 | Durchschlag | 246/448 |
| 6,354,541 | B1 * | 3/2002 | Achleitner et al. | 246/448 |
| 6,666,412 | B1 * | 12/2003 | Achleitner et al. | 246/450 |
| 6,789,770 | B2 * | 9/2004 | Schnedl | 246/448 |
| 7,178,764 | B2 * | 2/2007 | Klein | 246/257 |
| 7,191,986 | B2 * | 3/2007 | Achleitner et al. | 246/253 |
| 7,300,023 | B2 | 11/2007 | Biagiotti | |
| 7,674,065 | B2 * | 3/2010 | Schnedl et al. | 403/379.1 |
| 2004/0069911 | A1 * | 4/2004 | Schnedl | 246/448 |
| 2009/0277999 | A1 * | 11/2009 | Fox | 246/449 |
| 2012/0068022 | A1 * | 3/2012 | Chadda et al. | 246/448 |
| 2013/0068896 | A1 * | 3/2013 | Cord-Bruning et al. | 246/448 |

FOREIGN PATENT DOCUMENTS

| | | | |
|---|---|---|---|
| DE | 20106851 | U1 | 4/2001 |
| EP | 0779197 | A1 | 6/1997 |
| EP | 0824082 | A1 | 2/1998 |
| EP | 0858938 | A2 | 8/1998 |
| EP | 0869615 | A1 | 10/1998 |
| EP | 1348606 | A1 | 10/2003 |
| EP | 1623903 | A1 | 2/2006 |
| EP | 1345803 | B1 | 2/2008 |
| GB | 2006500 | A | 5/1982 |
| WO | 9930951 | A1 | 6/1999 |
| WO | 2005042330 | A1 | 5/2005 |
| WO | 2008142182 | A1 | 11/2008 |

OTHER PUBLICATIONS

United Kingdom Search Report dated Jan. 13, 2011.
Interim Novelty/Infringement Search Report.
United Kingdom Search Report dated Jan. 12, 2011.

* cited by examiner

*Primary Examiner* — Jason C Smith
(74) *Attorney, Agent, or Firm* — Baker & Hostetler LLP

(57) ABSTRACT

A mechanical lock for railway points comprising an outer tube and a linear arrangement of interlinked components arranged in a core of the outer tube, the interlinked components comprising five coaxially arranged, separately manufactured, elements, including a central tie and two link-rods, the two link rods being respectively interlinked at first ends thereof to opposing ends of the central tie by expandable components.

31 Claims, 6 Drawing Sheets

MECHANICAL LOCK

CROSS-REFERENCE TO RELATED APPLICATIONS

This application claims priority to and is a non-provisional of pending U.S. provisional patent application entitled, MECHANICAL LOCK, filed Sep. 16, 2010, having a Ser. No. 61/383,539, the disclosure of which is hereby incorporated by reference in its entirety.

FIELD OF THE INVENTION

The present invention relates to a mechanical lock. More particularly, the present invention relates to a mechanical lock for railway points, or for track switch gear, on a railway.

BACKGROUND OF THE INVENTION

Mechanical locks for railway points are known in the art for preventing a switch rail from creeping away from a stock rail over time, such as if hydraulic pressure drops in a rail-biasing ram. For example, one known actuator arrangement for operating railway points, or track switch gear, on a railway in which a pair of mechanical locks are provided on either side of a pair of hydraulic rams, each ram being arranged to act upon a respective switch rail, for driving that switch rail towards an adjacent stock rail, with the mechanical locks on either side of those rams being locking mechanisms for preventing those switch rails from creeping away from a respective stop rail unless biased away therefrom by an actuation of the opposing ram—the ram for biasing the other switch rail against its respective stock rail.

SUMMARY OF THE INVENTION

The present invention advantageously seeks to provide an alternative mechanical lock, and preferably one that can be more easily produced, or one which is easier to install, but which can also be used with the same, or similar hydraulic ram arrangements.

According to an embodiment of the present invention, there is provided a mechanical lock comprising an outer tube and a linear arrangement of interlinked components arranged in a core of the outer tube, the interlinked components comprising at least three coaxially arranged, separately manufactured, elements, including a central tie and two link-rods, the two link rods being respectively interlinked at first ends thereof to opposing ends of the central tie by expandable components.

The expandable components preferably each comprise a plurality of elements that are expandable away from one another, such as fingers of a collet-like arrangement.

Typically the link rods extend, at their opposite ends, out of the outer tube. Typically they will extend to respective brackets of an actuator mechanism for a railway points arrangement, the brackets being adapted to be driven by respective hydraulic rams of the actuator mechanism for moving respective switch rails relative to respective stock rails.

Typically the outer tube is mounted, in use, in a fixed position relative to a frame of an actuator mechanism for a railway points arrangement, or relative to the ground, or relative to a nearby sleeper.

Typically, the link-rods have rod ends for engaging internally of the expandable components.

Typically the internal surface of the outer tube is smooth walled. Preferably there are no grooves or recesses in the internal surface of the outer tube into which elements of the expandable components can engage or lock.

Typically each expandable component is adapted to interface with the respective end of the respective link-rod via a tapering surface.

Typically the interference between the end of the rod and the expandable component is such that a pushing of the rod towards its respective expandable component causes the expandable component to expand for bearing against the internal wall of the outer tube. That expansion causes an interference fit between at least a part of the expandable component's outer surface and the internal wall of the outer tube.

In one embodiment, the expandable components are each formed as collets, comprising a plurality of fingers extending from a base or body thereof, which collets may be of a one piece construction, such as with a base or body of a C section.

The expandable components may be formed of a plurality of separable components, such as an arrangement of fingers, which fingers may be connected together by one or more circlip, snap-ring or ring of wire.

Other collet-type arrangements would also be useable with the present invention.

In one embodiment, the expandable components are snap fitted onto the ends of the respective link-rods.

In one embodiment, the expandable components are snap fitted onto opposing ends of the central tie.

In one embodiment, the expandable components each comprise a plurality of fingers that are uniformly spaced around the ends of the respective link-rods or around the ends of the opposing ends of the central tie.

In one embodiment, the expandable components each have a tapering outer surface. Preferably that taper is a dual taper, i.e. such that the outer surfaces of the expandable components each define a distal taper that reduces towards the distal end thereof and a proximal taper that reduces towards the proximal end thereof. Alternatively the outer surface may be curved in the longitudinal direction. A point of inflection, or a point defining a maximum outer dimension part, is typically located within the middle third of the length of the respective component. This avoids a tendency for each expandable component to jam against the internal wall of the outer tube in the event that it twists out of true within the outer tube, i.e. unless the expandable component is caused to expand thereagainst.

Typically the outer tube has a cylindrical internal wall along its whole length.

Typically the outer surfaces of the expandable components define in transverse cross section, segments of a circle having a diameter substantially corresponding to, or slightly less than, the internal diameter of the outer tube.

Typically the outer tube is cylindrical, inside and out, although flanges for attaching that tube to external components may be provided on the outer surface of the tube.

In one embodiment, the link rods and the central tie have generally circular, cylindrical or annular cross sections along at least a substantial part of their lengths. Variations in diameter may be provided along those lengths to define the form of the components. Components with such circular, cylindrical or annular shapes are easy to fabricate, e.g. on a lathe. This design thus allows the products of the present invention to be manufactured both in large quantities and at low prices.

The elements of the expandable components may be molded—they typically don't individually have a circular or cylindrical cross section along at least a substantial part of their lengths, i.e. as a transverse section, although they may define individual frustrated segments of a circular or cylindrical cross section, such that collectively they may define an annular, or substantially annular, cross section.

In one embodiment, the rod ends engaged within the expandable components have a tapered outer surface, the tapers being such that they have a reducing dimension as the tapers lead towards the central tie.

In one embodiment, the expandable components each have a tapered inter surface having a reducing dimension as the taper leads towards the axial centre of the central tie.

In one embodiment, the mechanical lock substantially has a rotational symmetry about its longitudinal axis.

In one embodiment, the mechanical lock is substantially symmetrical about a transverse plane extending through the central tie's axial centre.

In one embodiment, the ends of the rod are provided as separable components from a shaft of the rod. Preferably the shaft of the rod extends to a bracket of an actuator mechanism for linking the rod relative to a switch rail.

An embodiment of the present invention also provides an actuator mechanism for a railway points arrangement fitted with at least one mechanical lock for locking switch rails in a desired position, the mechanical lock being as defined above, and the outer tube being mounted in a fixed position relative to a frame of the actuator mechanism. Typically the actuator mechanism comprises a pair of hydraulic rams, each ram having a base component that is mounted in a fixed position relative to the frame of the actuator mechanism.

Another embodiment of the present invention provides a railway points arrangement comprising a pair of stock rails, a pair of switch rails and an actuator mechanism as described above, the mechanical lock being a mechanism for locking one of the switch rails against its respective stock rail, the mechanical lock being arranged such that it extends substantially between the two switch rails, between two brackets of the actuator mechanism.

Another embodiment of the present invention provides a method for selectively locking the position of a pair of switch rails relative to a pair of stock rails comprising providing an actuator mechanism with a mechanical lock as defined above and arranging the mechanical lock to extend between the two switch rails, linking each link-rod to one of the switch rails via a bracket of the actuator mechanism, and mounting the outer tube of the mechanical lock in a fixed position relative to a frame of the actuator mechanism, or relative to the ground, or relative to a nearby sleeper upon which the stock rails are fixedly mounted.

Advantageously, any tendency for a switch rail to creep away from its associated stock rail, other than when driven by a pulling force caused by an operation of the actuator mechanism. will be mitigated since such creeping will causes a push to be exerted upon the link-rod that is linked to that switch rail, which in turn will cause a jamming of the associated expandable component against the internal wall of the outer tube.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

These and other features of the present invention will now be described in greater detail with reference to the accompanying drawings, in which.

DETAILED DESCRIPTION

Figure 1:
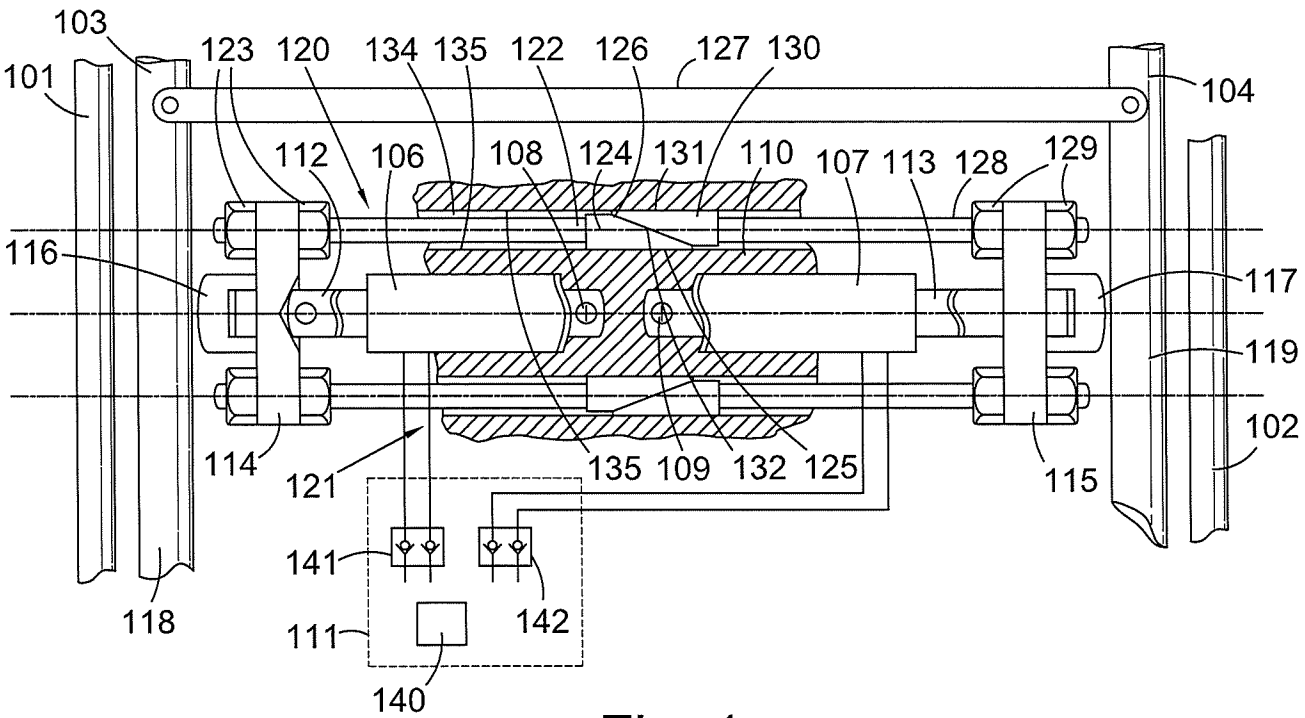
FIG. 1 shows a prior art points actuator mechanism suitable for adaptation in accordance with the present invention.

Referring first of all to FIG. 1, there is shown a prior art points actuator mechanism as disclosed in EP 1345803 A1, which is incorporated herein by reference in its entirety; this device has many features that will be compatible with the present invention. In particular, this device has two hydraulic rams or cylinders 106, 107, which are mounted onto a sleeper 110 at their bases 108, 109. Those rams or cylinders 106, 107 are each associated with a bracket 114, 115 and bushings or brushes 116, 117 at their respective ends for driving a respective switch rail 103, 104 from a position in which it is located away from its respective stock rail 101, 102 into a position in engagement with, or closer to, that stock rail 101, 102. Control for the powering of those rams comes from a supply unit 111, featuring a pump 140 and supply valves 141, 142.

The actuator mechanism is fitted with two mechanical locks 120, 121, each extending between the two brackets 114, 115, and those two mechanical locks 120, 121 comprise link rods 128 each with an engaging wedge 124, 130 on its end that is adapted to bear against the other wedge, upon pushing the rods together so as to cause the two wedges to displace transversely relative to one another as the wedges interact with each other, thus gripping against walls 135 in a rod supporting structure—typically a groove 134 within the sleeper 110. Each mechanical lock will thus operate so as to jam against those walls 135 in the event of a tendency for the respective switch rail 103, 104 to creep away from its respective stock rail 101, 102—that creeping causes the connected rod to push its wedge against the opposing wedge—thus locking that creeping switch rail 103, 104 from further movement.

The mechanical locks 120, 121, however, do not prevent switch rail movements when caused by a driving force from the respective hydraulic ram 106, 107, i.e. a driving of the ram 106, 107 to move its respective switch rail 103, 104 into engagement with its respective stock rail 101, 102. After all, that movement instead causes a pulling movement upon the mechanical lock (due to a movement of the bracket 114, 115), which pulling does not cause the wedges 124, 130 to bear against one another.

A tie 127 links the two switch rails together to prevent them from separating by more than an acceptable amount during such operations of the respective ram 106, 107. This can be a single tie 127, such as on either one of the two sides of the lock/ram, or elsewhere, or two ties as shown. One tie is generally sufficient.

Embodiments of the present invention operate in a very similar manner to the above-described arrangement, although the mechanical lock of this arrangement is replaced by an alternative mechanical lock arrangement, as shown in the following figures.

Figure 2:
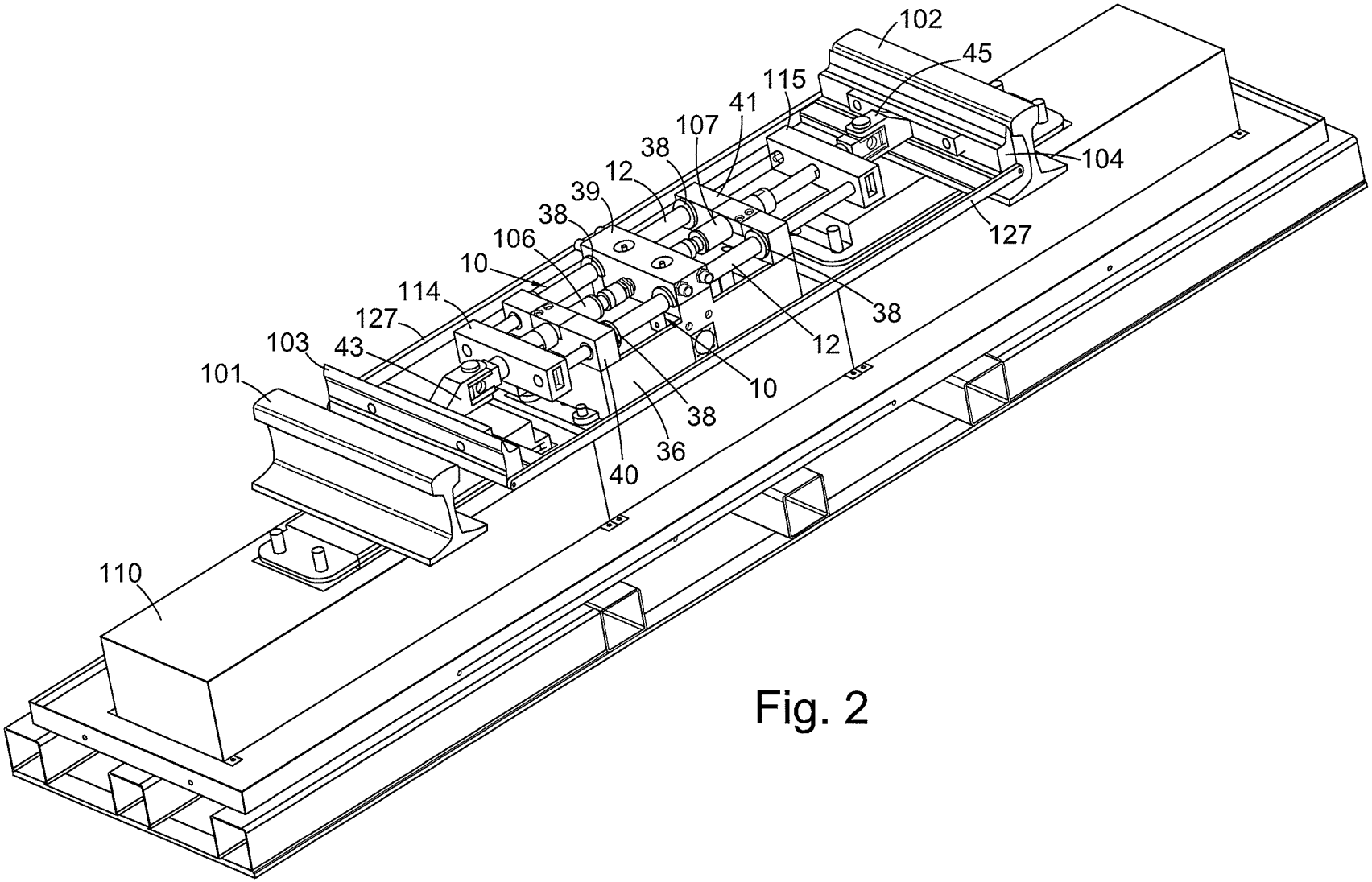
FIG. 2 shows a point actuator mechanism fitted with two mechanical locks in accordance with an embodiment of the present invention.
Figure 3:
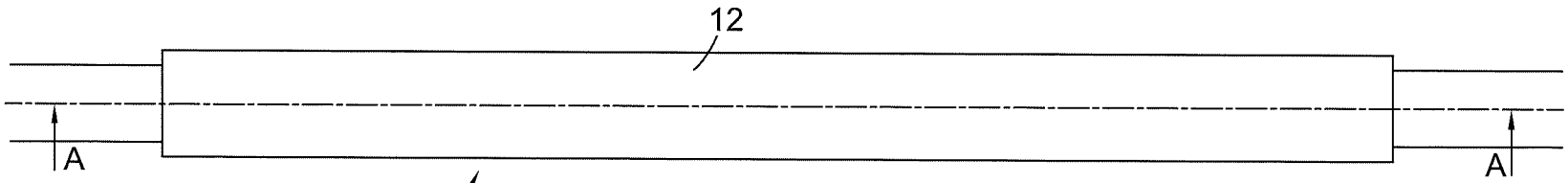
FIG. 3 shows an exterior view of part of a mechanical lock in accordance with an embodiment of the present invention.

FIG. 2 shows an alternative actuation mechanism for points on a railway line. Again two stock rails 101, 102 are shown, along with the switch rails 103, 104, the hydraulic rams 106, 107, the tie 127 (two in this version) and the sleeper 110. However, the brackets 114, 115, the bushings/brushes 43, 45 and mechanical locks are slightly modified. Nevertheless, since the present invention lies in the modifications to the mechanical locks, only the changed details of the mechanical locks will be discussed in detail in the following passages. Various embodiments of the present invention are presented in FIGS. 3 to 7, which depict, inter alia, the configuration of the mechanical lock 10.

Whereas in the embodiment of FIG. 1, the mechanical locks are both located within tracks carved into the sleeper 110, or sometimes in rectangular sectioned channels provided for that purpose, which channels might have been bolted onto the top of the sleeper, or secured within a frame of the actuation mechanism, the present invention comprises a single assembly for each of its mechanical locks, which assemblies are secured to the frame 36 of the actuator mechanism through a central bulkhead 39, and end bulkheads 40, 41. This is achieved with bushings 38. The bushings 38 can grip the mechanical lock on the outside thereof—along an outer tube 12 thereof—for fixing its position relative to the bulkheads 39, 40, 41 and the frame 36. It will be appreciated, however, that as in FIG. 1, where the rams 106, 107 are bolted to the sleeper, the mechanical locks might be bolted to the sleepers, again at the outer tube component thereof, for fixing that outer tube relative to the sleeper.

As shown, it is usual for two mechanical locks to be provided, as in the prior art arrangement shown in FIG. 1 one on either side of the two rams 106, 107. This keeps a symmetry in the forces experienced within the actuator arrangement for preventing any skewing thereof in response to mechanical forces experienced therein as a train passes through the points.

As shown, the two hydraulic rams 106, 107 are arranged coaxially. This is optional, although one does act upon one switch rail, and the other acts upon the other, with the mechanical locks extending between the switch rails.

Likewise the provision of two separate rams is optional. For instance, a dual acting ram can be used instead.

The two mechanical locks 10, as shown in FIG. 2, are arranged parallel to one another, either side of the two hydraulic rams 106, 107, on a fixed block 36 with the three bulkheads, and that block 36 is mounted on top of a sleeper 110, between the two stock rails. The block 36, however, could equally be arranged between two sleepers.

Referring next to FIGS. 3 to 6, the features of a mechanical lock will be explained in more detail.

The mechanical lock 10 comprises an outer tube 12, which is fixedly secured relative to the block 36 as mentioned above by bushings 38 (as in FIGS. 2 and 7). The tube 12 has a core through which extends the moving parts of the mechanical lock. Those movable parts comprise a linear arrangement of five interlinked components 14, as shown most clearly in FIG. 4, with the details thereof being shown in FIGS. 5 and 6.

The five components include a central tie 18, two link rods 22, 24 and two collet-like arrangements 32.

The central tie 18 comprises a central boss 42 and two distal bosses 44, each spaced from the central boss on respective stalks 46. The stalks and the bosses are linearly arranged such that they are coaxial to one another.

The cross section of each section of this central tie 18 is generally cylindrical, although the various sections have a variety of diameters. For example, the distal bosses 44 have an intermediate diameter, the stalks have a smaller diameter and the central boss 42 has a larger diameter. Rounded interchanges delimit these cylindrical sections.

Non cylindrical sections are also possible.

The size of the central boss 44 is defined so as to allow that central boss to provide a centralizing and stabilizing influence on the central tie 18 relative to the core 16 of the outer tube 12. For that purpose the central boss 42 preferably has shape of a generally cylindrical nature, with rounded corners and a substantially constant cross section along the majority of the rest of its length.

The diameter of that central boss is preferably at most 96% of the inside diameter of the core 16 of the outer tube 12, whereby it will be free to slide therealong.

The length of that central boss is preferably of a sufficient length, namely at least 50% of its diameter, so as to ensure it will slide freely along that outer tube without significant tendency to decentralize/destabilize relative to the axis of the outer tube 12. This is to prevent inadvertent jamming of the central boss against the internal wall 30 of the outer tube 12.

To further prevent inadvertent jamming of the central boss within the outer tube, the edges of the central boss 42 are rounded.

The stalks 46 step down in diameter considerably relative to the size of the central boss 42, thus defining two shoulders 48 for the central boss 42. Those shoulders 48 preferably each occupy a radial dimension of about two thirds of the radius of the central boss 42. The stalks thus each have a diameter of approximately ⅓ of the diameter of the central boss 42. The interchange between the shoulders 48 of the central boss 42 and the main shaft of the stalks 46 is preferably radiused to reduce any stress concentrations resulting thereat—the mechanical locks are loaded with a tensile force whenever the points are changed.

The stalks then preferably define a generally cylindrical extent, with a constant cross section, substantially all the way across to the distal bosses 44, although a further radiused interchange is again provided.

The distal bosses then define respective further shoulders 50 to step outwardly to the outer radius of those distal bosses 44. Preferably the radius of those distal bosses 44 is approximately 50% of the radius of the central boss 42 (or the diameter of the distal bosses is 50% of the diameter of the central boss).

The distal bosses 44 then terminate at their free ends with a substantially flat outer face.

By having a generally cylindrical outer surface, the distal bosses 44 will tend to serve no function in the operation of the mechanical lock 10. That is because that outer surface will not bear against the inner surface of the collets, or collet fingers 32, which are spaced thereabout, and discussed below. The shape of that outer surface is thus non-critical.

Referring now to the collets, or collet-like elements, they form the second and third elements of the linear arrangement of five interlinked components 14. They comprise an array of fingers 32, spaced around the distal bosses 44 of the central tie 18.

The finger elements are preferably cast, whereas the central tie 18 can be cast or fabricated on a lathe, due to its circular cross section.

Figure 5:
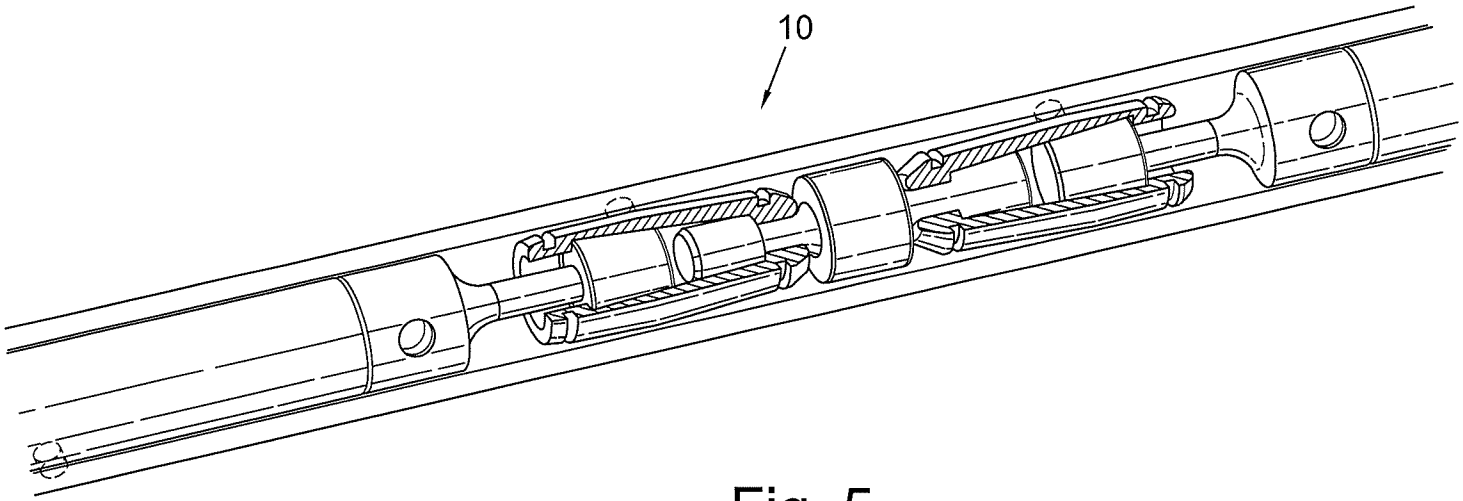
FIG. 5 shows a partial cross sectional perspective view of the mechanical lock of FIG. 3.

Two collets each comprise a set of four fingers 32, although a different number of fingers, or other collet-like arrangements, can be provided. Each of the fingers 32 engage over the distal bosses 44 of the central tie 18 for catching thereon over the further shoulders 50, nearby the stalks 46. The four fingers 32 thus substantially surround each distal boss 44. They are shown in FIG. 5 to be equi-spaced around the central tie—one finger from each collet-type arrangement is removed for clarity.

In place of this multi-component collet, with four fingers, a single piece collet, or a two piece collet might be provided. The provision of at least three finger-like parts is preferred, however, since they provide a better engagement against the internal wall 30 of the outer tube 12.

Figure 6:
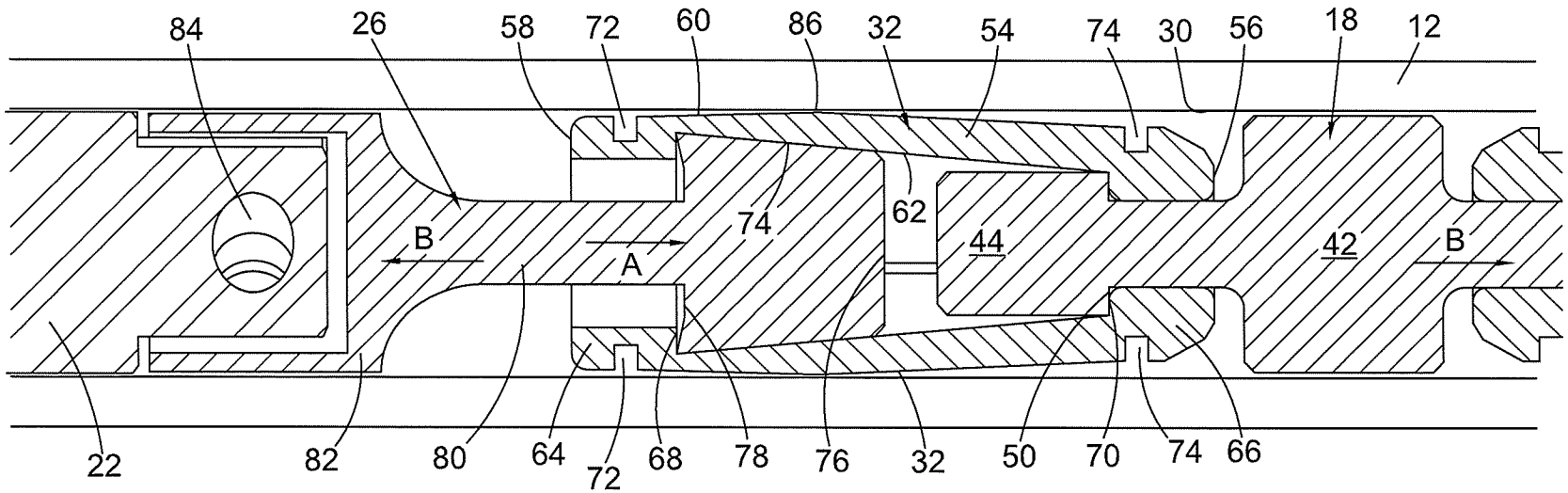
FIG. 6 is a detail view of the area shown in FIG. 4.
Figure 7:
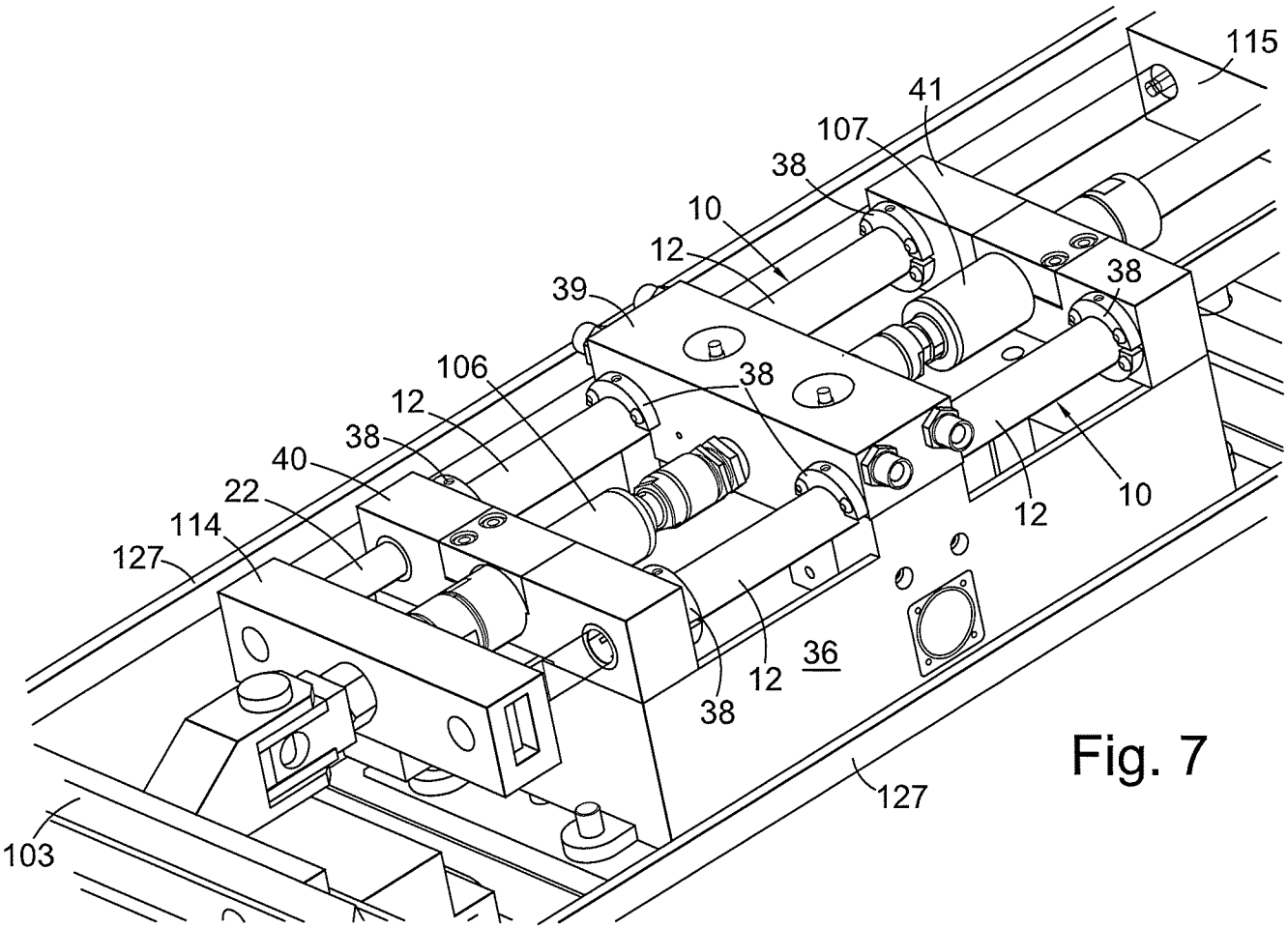
FIG. 7 is a detail view of the area shown in FIG. 2.

Each finger, as shown in FIG. 6, comprises a main body 54, a distal end 56, a proximal end 58, an outer surface 60 and an inner surface 62. Since there are four fingers in this embodiment, the planar cross section of FIG. 6 shows the two fingers to have a common cross section. After all the fingers will be spaced at 90° to one another, thus having two pairs of two opposing fingers. With three fingers, they may be spaced around the distal bosses 44 differently, i.e. at 120° to one another.

The inner surface 62 of each finger defines two end portions 64 and 66. The proximal end portion 64 steps inwardly relative to the inner surface 62 of the main body 54 near the proximal end 58 of the finger 32, whereas the distal end portion 66 steps inwardly relative to the inner surface 62 near the distal end 56 of the finger 32. That stepping inward for both the proximal and distal end portions each define shoulders 68, 70 for the inner surface 62 of the fingers 32. The distal shoulder 70 is adapted to engage behind the shoulder 50 of its respective distal boss 44 of the central tie 18. The proximal shoulder 68, however, is instead for engaging over a shoulder of a respective rod end 26, which rod end 26 will be described in further detail below.

The depth of the distal shoulder 70 is preferably similar to, or fractionally greater than, the depth of the further shoulder 50 on the distal boss 44 of the central tie. This is to ensure a good engagement between those two shoulders. The depth of the proximal shoulder 68 is preferably similar to the depth of the distal shoulder 70, although it can be even larger than it.

Each end portion 64, 66 is provided with a segment of an annular groove 72, 74 in it, extending circumferentially in use relative to the outer tube. The eight segments thus form two intermittent annular grooves into which two circlips or wire loops, or the like, can be located for linking the four fingers 32 together, preferably in an expandable manner, such as by having the circlip or wire loop expand, or by having the circlips or wire loops only loosely fitting in the grooves. Each set of four fingers thus forms, collectively, a further component in the linear arrangement of interlinked components, which component is engageable over the distal boss of its central tie, that engageability certainly being possible before the circlip, or loop of wire, is put in place, but also, depending upon the looseness or flexibility of that circlip or loop of wire, potentially also being possible after the circlip or loop of wire has been put in place. The circlip or ring of wire is not illustrated.

In place of this multi-part component, a split collet might instead be used. For example, either or both of the end portions 64, 66 could be made from a C shaped section with an open slit at the mouth of the C. That would be for allowing an expansion of the collet for mounting that collet over the respective distal boss 44, or even for mounting it over the rod end 26, the details of which are given below.

In a further arrangement, the rod end 26 or distal bosses 44 could themselves be radially, and resiliently, collapsible. Then they themselves would allow the fingers, or the collet, to be snapped thereover.

In yet another arrangement, the fingers 32 and central tie may be integrated into a single component, such as by integrally forming them on the distal bosses 44, or on the central boss 42, thus providing the possibility of just having just three linearly arranged, interlinked components 14 within the outer tube 12.

Returning to the illustrated embodiment, the inner surface 62 of the fingers 32 between the proximal and distal end portions 64, 66 define a tapered, frustoconical design, tapering inwardly towards the distal ends of the fingers 32. That tapering down in this preferred arrangement continues to the distal shoulders 70 of the fingers 32. As a result, the inner surface 62 of the main body 54 near the distal end portion 66 of the fingers 32 will be spaced away from the outer surface of its respective distal boss 44, as mentioned above. Thus, as described above, the outer surface of the distal boss 44 does not engage the inner surface 62 of the fingers 32, whereby it serves no function.

That tapering inner surface 62, however, is instead engaged by a correspondingly tapered, and also frustoconical, outer surface 74 of a respective rod end 26, towards the proximal half of that tapering inner surface 62. The outer surface 74 of the rod end 26 can thus selectively bias the fingers 32 apart, relative to one another, for thus expanding the diameter of the outer surface 16 of the arrangement of fingers 32, or of the collet (if it is instead provided a collet).

To allow the expansion, the circlip, or ring of wire, located within the segments of the annular groove 72, will not be a close fitting fit within that annular groove. The expansion of the fingers to at least a limited degree is thus achievable selectively, i.e. upon pushing the rod end into the collet-like arrangement.

The expansion of the fingers 32 will cause the outer surface 60 of the fingers 32 to bear against the internal wall 30 of the outer tube 12. That bearing force will thus cause a frictional engagement of the fingers 32 against that internal wall 30, thus jamming further movement of the rod end when pushed in the direction shown by the arrow A in FIG. 6.

This arrangement, however, is selective since upon pulling the linear arrangement of interlinked components 14 (as shown by arrow B in FIG. 6), would instead disengage the force between the outer surface 74 of the rod end 26 and the inner surface 62 of the main body 54 of the fingers 32, thereby preventing an expansion of the fingers, which in turn prevents any increase in the resistance to sliding of the linear arrangement of interlinked components 14 within the altitude 12 from occurring. The arrangement can thus slide in response to such a pulling action (pulling actions occur in response to actuations of the hydraulic rams, so this non-locking characteristic is important).

Figure 4:
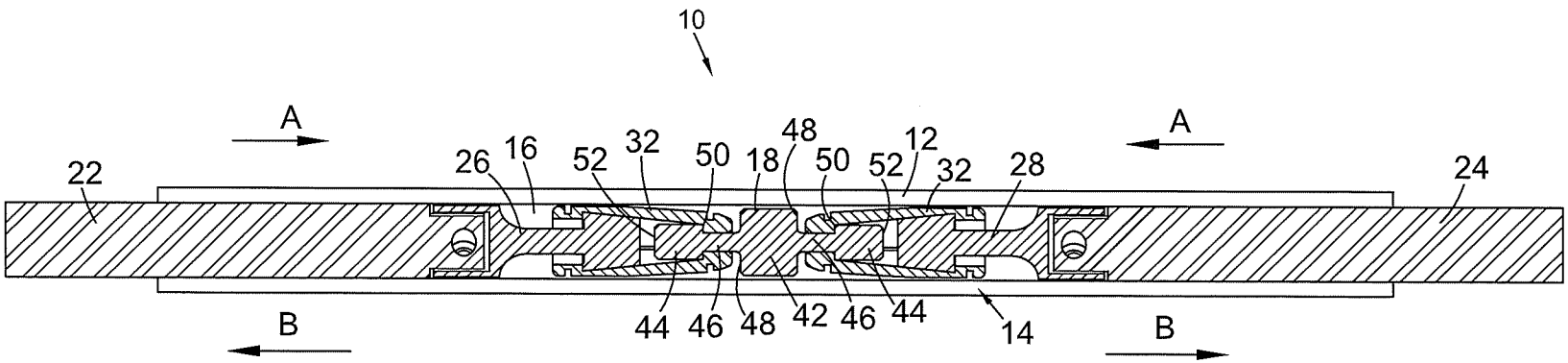
FIG. 4 shows a cross section through FIG. 3.

It should be further appreciated that pulling rods 22, 24 in either direction—two arrow Bs are provided in FIG. 4—will not cause a jamming of the linear arrangement of interlinked components 14 within the outer tube 12, whereas pushing those same rods in the directions shown by arrows A in FIG. 4 will cause a jamming of the fingers 32 of that respectively pushed rod 22, 24 against the internal wall 30 of the outer tube 12.

Returning again to FIG. 6, one of the rod ends 26 is shown in detail. The other rod end 28 is shown in FIG. 4 and is symmetrically arranged within a corresponding arrangement of fingers 32 on the other side of the central tie 18.

That rod end 26 has the above mentioned frustoconical outer surface 74, which outer surface 74 terminates at an end wall 76. That end wall 76 faces the end wall of the distal boss 44 but is spaced apart therefrom so that they cannot push against each other during use of the mechanical lock.

The proximal end of the outer surface 74 then defines an inward shoulder 78 about which the proximal shoulders 68 of the fingers 32 engage. Thus, a pulling of the rod end 26 in the direction of arrow B will pull the inward shoulder 78 against the proximal shoulders 68 of the fingers 32.

The inward shoulders 78 of the rod end 26 provides a mushroom like head for the rod end 28. That mushroom head has a stalk 80 extending out beyond the proximal ends 58 of the fingers 32 to a main body or trunk 82 of the rod end 26. That trunk 82 has a cavity which fits over an end of the respective link rod 22, which rod 22 extends proximally therefrom for attachment to a bracket 114 of the actuator arrangement, as described above and shown in FIGS. 2 and 7.

The connection between the distal end of the link rod 22 and the trunk 82 of the rod end 26 can be provided as a pinned joint. For that purpose, a hole 84 is shown through the trunk 82 and through the distal end of the link rod 22. See FIG. 5. The rod end 26, however, may be integrally formed onto the distal end of the link rod 22, rather than being separable components. The use of separable component, however, allows rods of different lengths to be provided for allowing the mechanical lock to be interchangeable between different track gauges and different actuator mechanisms.

The outer diameter of the trunk 82 of the rod end 26 is smaller than the internal diameter of the outer tube 12 so as to run freely therealong. Preferably it is about 95% of the internal diameter of the outer tube 12. Preferably it also has a length of at least 50% of its diameter, whereby it will not twist off axis relative to that outer tube.

As can be seen the stalk 80 of the rod end 26 is of a sufficient length to take any shoulder between the stalk 80 and trunk 82 well beyond the proximal end 58 of the fingers 32. This prevents the shoulder between the stalk 80 and the trunk 82 from engaging the proximal ends of the fingers 32.

Referring now back to the fingers 32, and in particular the outer surface 60 thereof, as shown in FIG. 6 that outer surface tapers in two directions from a maximum outer dimension part thereof—the inflection point 86. That inflection point 86 is the part of the fingers that first engages against the internal wall 30 of the outer tube 12. Distally of that inflection point 86, the outer surfaces 60 of the fingers taper inwardly towards the distal ends 56 thereof. Proximally of that inflection point 86, the outer surfaces 60 taper inwardly towards the proximal ends 58 of the fingers 32. Those outer surfaces 60 thus have dual tapers, although they could instead be rounded. By the provision of the tapers, or rounded surfaces, the fingers 32 will not tend to jam within the outer tube until caused to do so by a force from the outer surface 74 of the rod end 26 located therein.

Preferably the taper or curvature of those outer surfaces 60 cause the outer surfaces at the end portions 64, 66 to be at least 5% smaller than the internal diameter of the core of the outer tube 12.

With this arrangement, therefore, a very easy to manufacture arrangement is provided in which a stationary outer tube is provided within which a linear arrangement of interlinked components 14 are provided. Those interlinked components each providing part of a mechanism to cause the interlinked components to jam within the outer tube when pushed through the outer tube but for them to slide freely within the outer tube 12 when pulled therethrough and to achieve this without any tendency to jam at other times, such as if any rattling thereof may occur during passage of trains on the rails in the vicinity thereof.

The present invention has been described above purely by way of example. Modifications in detail may be made thereto within the scope of the claims appended hereto.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A mechanical lock, comprising an outer tube and a linear arrangement of interlinked components arranged in a core of the outer tube, the interlinked components comprising at least three coaxially arranged, separately manufactured, elements, including a central tie and two link-rods, the two link rods being respectively interlinked at first ends thereof to opposing ends of the central tie by expandable components.

2. A mechanical lock according to claim 1, wherein the expandable components each comprise a plurality of elements that are expandable away from one another.

3. A mechanical lock according to claim 2, wherein the expandable components are fingers of a collet-like arrangement.

4. A mechanical lock according to claim 1, wherein the link rods extend, at their opposite ends, out of the outer tube.

5. A mechanical lock according to claim 1, wherein the link rods extend, at their opposite ends, to respective brackets of an actuator mechanism for a railway points arrangement.

6. A mechanical lock according to claim 1, wherein the outer tube is mounted, in use, in a fixed position relative to a frame of an actuator mechanism for a railway points arrangement, or relative to the ground, or relative to a nearby sleeper.

7. A mechanical lock according to claim 1, wherein the link-rods have rod ends for engaging internally of the expandable components.

8. A mechanical lock according to claim 1, wherein the internal surface of the outer tube is smooth walled.

9. A mechanical lock according to claim 1, wherein there are no grooves or recesses in the internal surface of the outer tube into which elements of the expandable components can engage or lock.

10. A mechanical lock according to claim 1, wherein each expandable component is adapted to interface with the respective end of the respective link-rod via a tapering surface.

11. A mechanical lock according to claim 1, wherein the interference between the end of each rod and the respective expandable component is such that a pushing of the rod towards its respective expandable component causes the expandable component to expand for bearing against the internal wall of the outer tube.

12. A mechanical lock according to claim 1, wherein the expandable components are each formed as collets, comprising a plurality of fingers.

13. A mechanical lock according to claim 1, wherein the expandable components are each formed of a plurality of separable components.

14. A mechanical lock according to claim 13, wherein the separable components are a plurality of fingers connected together by one or more circlip, snap-ring or ring of wire.

15. A mechanical lock according to claim 1, wherein the expandable components each comprise a plurality of fingers that are uniformly spaced around the ends of the respective link-rods or around the ends of the opposing ends of the central tie.

16. A mechanical lock according to claim 1, wherein the expandable components each have a tapering outer surface.

17. A mechanical lock according to claim 16, wherein the taper is a dual taper, such that the outer surfaces of the expandable components each define a distal taper that reduces towards the distal end thereof and a proximal taper that reduces towards the proximal end thereof.

18. A mechanical lock according to claim 1, wherein the outer tube has a cylindrical internal wall along its whole length.

19. A mechanical lock according to claim 1, wherein outer surfaces of the expandable components define in transverse cross section, segments of a circle having a diameter substantially corresponding to, or slightly less than, the internal diameter of the outer tube.

20. A mechanical lock according to claim 1, wherein the link rods and the central tie have generally circular, cylindrical or annular cross sections along at least a substantial part of their lengths.

21. A mechanical lock according to claim 1, wherein the elements of the expandable components define individual frustrated segments of a circular or cylindrical cross section, such that collectively they define an annular, or substantially annular, cross section.

22. A mechanical lock according to claim 1, wherein the rod ends engaged within the expandable components have a tapered outer surface.

23. A mechanical lock according to claim 1, wherein the expandable components each have a tapered inter surface having a reducing dimension relative to the axis of the lock as the taper leads towards the axial centre of the central tie.

24. A mechanical lock according to claim 1, wherein the mechanical lock substantially has a rotational symmetry about its longitudinal axis.

25. A mechanical lock according to claim 1, wherein the mechanical lock is substantially symmetrical about a transverse plane extending through the axial center of the central tie.

26. A mechanical lock according to claim 1, wherein the ends of the rod are provided as separable components from a shaft of the rod.

27. An actuator mechanism for a railway points arrangement fitted with at least one mechanical lock for locking switch rails in a desired position, the mechanical lock being in accordance with claim 1, and the outer tube thereof being mounted in a fixed position relative to a frame of the actuator mechanism.

28. An actuator mechanism of claim 27, wherein the actuator mechanism comprises a pair of hydraulic rams, each ram having a base component that is mounted in a fixed position relative to the frame of the actuator mechanism.

29. A railway points arrangement comprising a pair of stock rails, a pair of switch rails and an actuator mechanism according to claim 28, the mechanical lock thereof being a mechanism for locking one of the switch rails against its respective stock rail, the mechanical lock being arranged such that it extends substantially between the two switch rails, between two brackets of the actuator mechanism.

30. A method for selectively locking the position of a pair of switch rails relative to a pair of stock rails comprising providing an actuator mechanism with a mechanical lock according to claim 1 and arranging the mechanical lock to extend between the two switch rails, linking each link-rod of the mechanical lock to one of the switch rails via a bracket of the actuator mechanism, and mounting the outer tube of the mechanical lock in a fixed position relative to a frame of the actuator mechanism, or relative to the ground, or relative to a nearby sleeper upon which the stock rails are fixedly mounted.

31. A method for selectively locking the position of a pair of switch rails relative to a pair of stock rails comprising providing an actuator mechanism with a mechanical lock according to claim 29 and arranging the mechanical lock to extend between the two switch rails, linking each link-rod of the mechanical lock to one of the switch rails via a bracket of the actuator mechanism, and mounting the outer tube of the mechanical lock in a fixed position relative to a frame of the actuator mechanism, or relative to the ground, or relative to a nearby sleeper upon which the stock rails are fixedly mounted.

* * * * *